US009242462B2

(12) United States Patent
Stephens

(10) Patent No.: US 9,242,462 B2
(45) Date of Patent: Jan. 26, 2016

(54) SINGLE JET FLUIDIC DESIGN FOR HIGH PACKING DENSITY IN INKJET PRINT HEADS

(71) Applicant: XEROX CORPORATION, Norwalk, CT (US)

(72) Inventor: Terrance L. Stephens, Canby, OR (US)

(73) Assignee: XEROX CORPORATION, Norwalk, CT (US)

( * ) Notice: Subject to any disclaimer, the term of this patent is extended or adjusted under 35 U.S.C. 154(b) by 59 days.

(21) Appl. No.: 14/095,127

(22) Filed: Dec. 3, 2013

(65) Prior Publication Data

US 2015/0151539 A1 Jun. 4, 2015

(51) Int. Cl.
*B41J 2/14* (2006.01)

(52) U.S. Cl.
CPC ..... *B41J 2/14233* (2013.01)

(58) Field of Classification Search
CPC ..... B41J 2/14233
USPC ..... 347/47
See application file for complete search history.

(56) References Cited

U.S. PATENT DOCUMENTS 5,914,735 A * 6/1999 Yamamoto et al. ..... 347/33
5,940,099 A * 8/1999 Karlinski ..... B41J 2/14233 347/70
2003/0227512 A1* 12/2003 Tanaka et al. ..... 347/40

* cited by examiner

*Primary Examiner* — Stephen Meier
*Assistant Examiner* — Alexander D Shenderov
(74) *Attorney, Agent, or Firm* — Marger Johnson

(57) ABSTRACT

A jet stack has a set of plates forming an array of body chambers, the set of plates including a nozzle plate having an array of jets wherein each jet corresponds to a body chamber, each body chamber having an inlet to allow fluid to flow into the body chamber and an outlet to allow fluid to flow out of the body chamber, the outlet fluidically coupled to a jet in the array of jets, wherein the inlet and outlets are concentric.

9 Claims, 5 Drawing Sheets

SINGLE JET FLUIDIC DESIGN FOR HIGH PACKING DENSITY IN INKJET PRINT HEADS

BACKGROUND

Inkjet print heads typically include a 'jet stack,' a stack of plates that form manifolds and chambers of an ink path from an ink reservoir to an array of nozzles or jets. Ink enters the jet stack from the reservoir and is routed through the ink path to the final plate that contains an array of nozzles or jets through which the ink selectively exits the jet stack. Signals drive an array of transducers that operate on a pressure chamber or body chamber adjacent each jet. When the transducer receives a signal to jet the ink, it pushes ink out of the body chamber through the jet to the printing surface.

The desire for higher resolution images, and increased throughput, results in the need for higher and higher packing density for the jets. The packing density is the number of jets that exist within some predefined space. Space requirements for each jet limit the number of jets that can fit within that space. Current print head designs typically have a serial flow path. Fluid flows into the body chamber through a first discrete fluid element and then flows out of the body chamber through a second discrete fluid element that leads to the corresponding single jet aperture. Each of these fluid elements use a certain amount of real estate associated with the jet stack and have to have some distance between them for separation as well. These effects act to limit the number of single jets that can be packed within the space of any given jet stack.

DETAILED DESCRIPTION OF THE EMBODIMENTS

Figure 1:
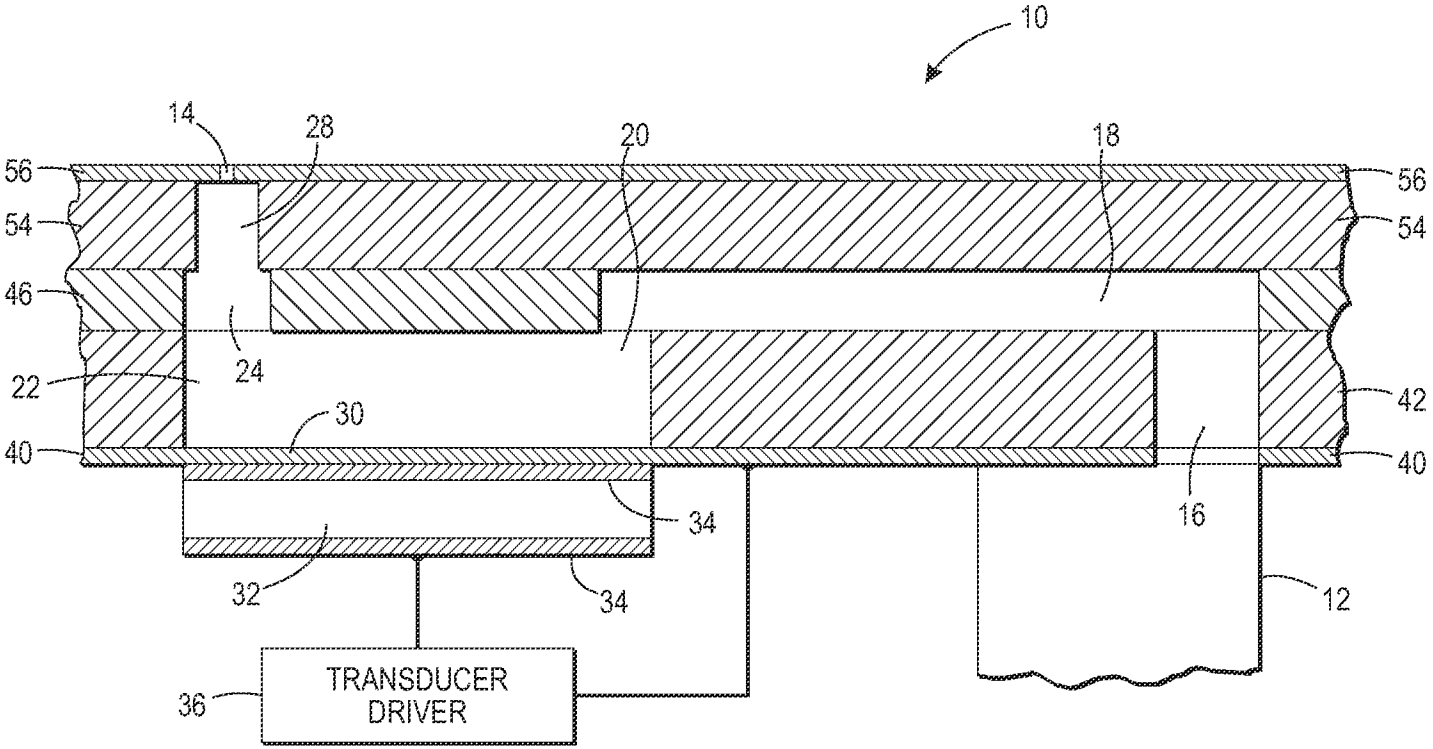
FIG. 1 shows a side view of an inkjet jet stack.

FIG. 1 shows an example of a single jet 10 in a jet stack. In this example, the jet stack consists of a particular number and configuration of plates with the understanding that the actual composition of the jet stack may vary, as well as the variation in the particular components, such as the type and construction of the transducer, etc. Further, while the particular fluid discussed here is ink within an inkjet printer, the embodiments here may apply to other types of fluid dispensing elements. The jet stack typically encompasses an array of jets, each with their own corresponding inlet, body chamber and outlet. The jets are the individual elements, referred to here as jet or jetting elements. The term jet here encompasses all of the elements that direct the ink, including the inlet and outlet ports, body chamber, and ultimately the nozzle or aperture.

In the example of FIG. 1, the jet element consists of an ink path starting with an inlet port 16, an inlet channel 18, and a pressure chamber inlet port 20 to the pressure chamber or body chamber 22. The ink exits the pressure chamber through the outlet port 24 to the outlet channel 28. The ink ultimately exits the jet stack through a nozzle 14. The transducer 32 actuates in response to a signal from the transducer driver 36 to the transducer elements 34. In this particular example, the transducer deforms in response to the signal, first to deform away from the pressure chamber to draw ink into the chamber. The transducer then pushes towards the pressure chamber to force the ink in the chamber out to the nozzle. The channels, ports and chambers shown in FIG. 1 are formed from a series of plates, such as the diaphragm plate 40, pressure chamber plate 42, channel plate 46, outlet plate 54 and nozzle plate 56.

Figure 2:
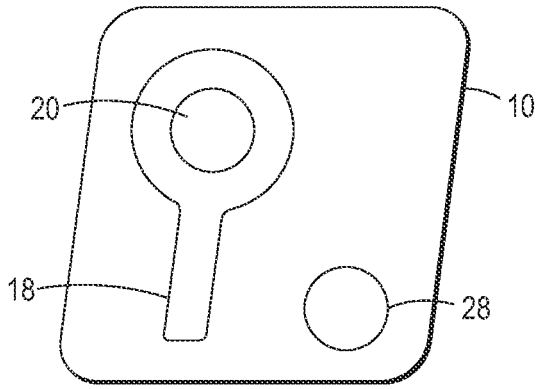
FIG. 2 shows a plan view of a serial flow single jet.

As can be seen by the example of FIG. 1, the ink inlet into the body or pressure chamber and the outlet to the nozzle are two discrete elements. FIG. 2 shows a plan view of a portion of an array of elements of the jet 10 in the jet stack in current implementations. The inlet 18 feeds into the port 20 that goes into the body chamber. The outlet 28 is in a separate area of the jet. The elements shown in FIG. 2 reside inside the jet stack, and the view is from the nozzle plate side of the jet stack.

Figure 3:
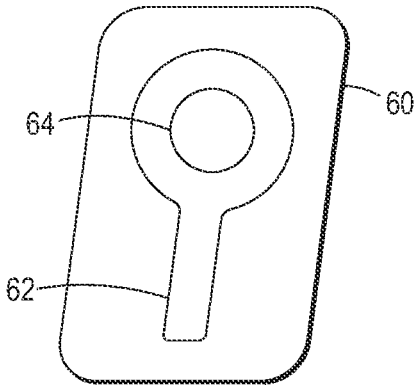
FIG. 3 shows a plan view of a parallel flow single jet.

FIG. 3 shows a jet 60 having an architecture in which the inlet and outlet ports leading to the body chamber use the same channel. The body chamber has an ink inlet 62 that feeds ink into the body chamber. The outlet 64 uses the same exit as the entrance. This reduces the necessary space within the jet stack for each jet element, allowing for higher packing density. This may be seen more clearly in three dimensions as shown in FIGS. 4 and 5.

Figure 4:
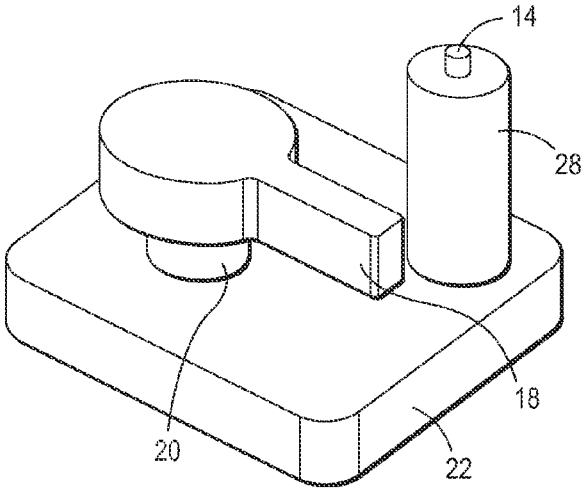
FIG. 4 shows a three-dimensional view of a serial, single jet structure.

FIG. 4 shows a three-dimensional representation of a jet element such as 10 in FIG. 1. The ink inlet 18 feeds ink from the reservoir 12 to the inlet port 20 into the body chamber 22. The ink outlet channel 28 routes the ink to the exit aperture or nozzle 14. In this particular embodiment, the ink inlet path and the ink outlet paths are perpendicular to each other. While they may not necessarily be arranged in that fashion, the two paths will generally be arranged separate from each other. When the inlet port and the exit port exist as separate elements, this results in the jet element using more space.

Figure 5:
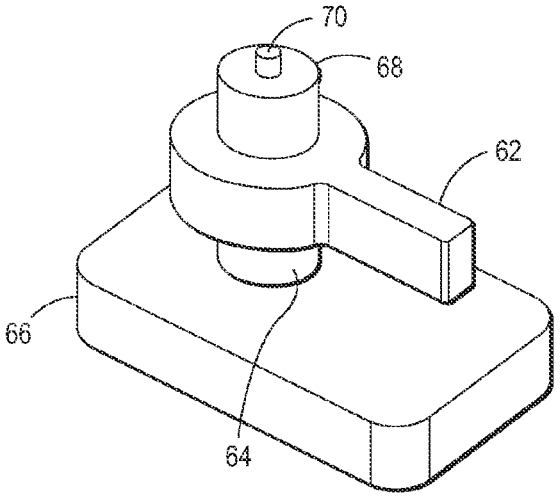
FIG. 5 shows a three-dimensional view of a parallel, single jet structure.

In contrast, FIG. 5 shows a jet element that uses the same fluid element for the entrance and exit path to and from the body chamber. The ink inlet path 62 feeds the body chamber 66 through the inlet port 64 when the transducer is operated to draw ink into the body chamber. When the operation is to jet ink out of the nozzle 70, the port 64 becomes the output port that sends ink out the outlet channel 68 to the nozzle 70.

Figure 6:
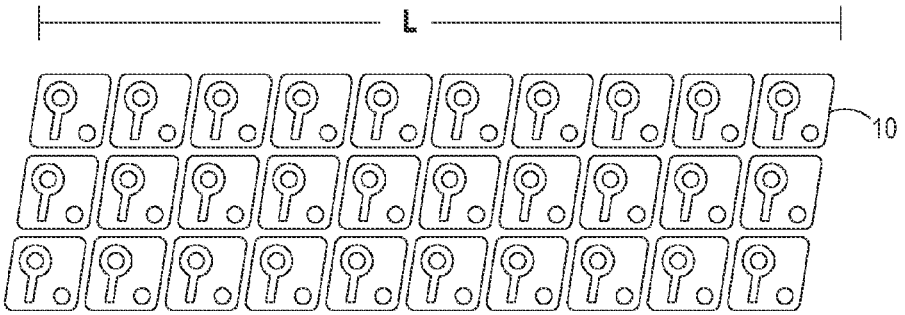
FIG. 6 shows an array of serial flow single jets.
Figure 7:
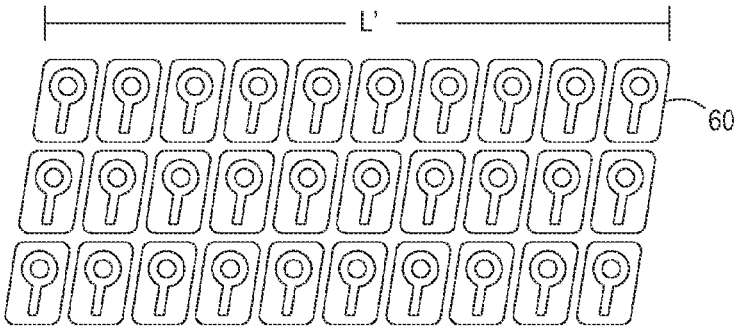
FIG. 7 shows an array of parallel flow single jets.

FIGS. 6 and 7 demonstrate how the difference in architecture of each jet results in a different quantity of jets being able to fit within the same amount of space. As packing density is increased, it is possible to achieve higher resolution and increased throughput from the same sized print head. In FIG. 6, as an example, 10 jets can fit onto a portion of the nozzle plate having a length L. These jets each have separate inlets and outlets. By comparison, the jets of FIG. 7 have the combined inlet and outlet. In FIG. 7, 10 jets fit into a length L' that is shorter than the length L of FIG. 6. This provides a higher packing density for the jets.

Figure 8:
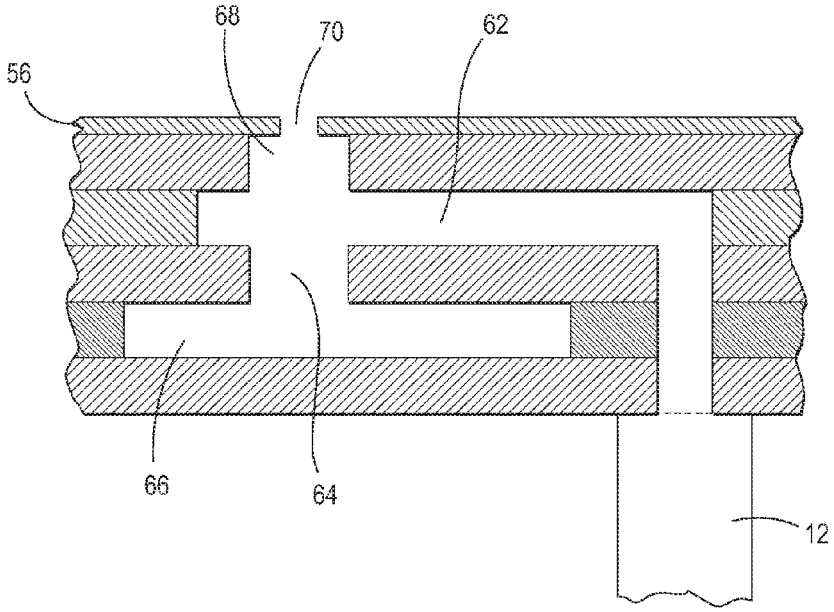
FIG. 8 shows a side view of a parallel, single jet structure of an inkjet stack.

FIG. 8 shows a side view of a parallel, single jet structure of an inkjet stack. Similar to FIG. 1, the paths, channels, ports, and chambers shown in FIG. 8 are formed from a set of stacked plates, including a nozzle plate 56. The ink inlet path 62 feeds ink from the reservoir 12 to the inlet port 64. The ink then passes into the body chamber 66. As noted for FIG. 5, when the operation is to jet ink out of the aperture or nozzle 70, the port 64 becomes the output port that sends ink out through the outlet channel 68 to the nozzle 70. Thus, the jet element of FIG. 8 uses the same fluid element for the entrance and exit path to and from the body chamber 66.

As mentioned previously, using jet architectures embodied here, one can increase the packing density of the jets. The packing density refers to the number of jets per unit of area. For example, one current jet architecture allows for 0.5 jets/$mm^2$. Using the principles of jet architectures demonstrated here, this could increase to 0.75-1.25 jets/$mm^2$. Another example has a packing density of 1 jet/$mm^2$, which could increase to 1.5-2.5 jets/$mm^2$. Yet another example has 2 jets/$mm^2$, which could increase to 3-5 jets/$mm^2$.

It will be appreciated that several of the above-disclosed and other features and functions, or alternatives thereof, may be desirably combined into many other different systems or applications. Also that various presently unforeseen or unanticipated alternatives, modifications, variations, or improvements therein may be subsequently made by those skilled in the art which are also intended to be encompassed by the following claims.

What is claimed is:

1. A jet stack, comprising:

a set of stacked plates including a nozzle plate having at least one aperture, the set of stacked plates configured to form at least one body chamber, the at least one body chamber corresponding to the at least one aperture and having a fluid port configured to allow fluid to flow from an inlet path in the set of stacked plates to the fluid port, and then through the fluid port and into the at least one body chamber, and also to flow from the at least one body chamber to the fluid port and then through the fluid port to the at least one aperture.

2. The jet stack of claim 1, wherein the fluid comprises ink.

3. The jet stack of claim 2, wherein the inlet path is coupled to a reservoir of ink, in which the inlet port is configured to introduce the ink from the reservoir of ink into the fluid port.

4. The jet stack of claim 1, in which the set of stacked plates is further configured to form an outlet channel configured to receive the fluid from the fluid port and to introduce the fluid from the fluid port to the at least one aperture.

5. The jet stack of claim 4, wherein the inlet path and the outlet channel are perpendicular.

6. The jet stack of claim 4, in which the fluid port is concentric with the outlet channel.

7. A print head, comprising:

an ink reservoir; and a set of plates forming a jet stack, the jet stack comprising:

a nozzle plate having at least one nozzle;

at least one body chamber fluidically coupled to the at least one nozzle and to the ink reservoir;

a channel configured to allow ink from the ink reservoir to flow into the at least one body chamber through the channel and to allow ink to flow out of the at least one body chamber through the channel;

an inlet path configured to transmit the ink from the ink reservoir into the at least one body chamber through the channel; and an outlet path configured to receive the ink from the at least one body chamber through the channel and to transmit the ink to the at least one nozzle.

8. The print head of claim 7, wherein the ink reservoir contains solid ink.

9. The print head of claim 7, in which the channel is concentric with the outlet path.

* * * * *